United States Patent [19]

Klötzer

[11] Patent Number: 4,590,155

[45] Date of Patent: May 20, 1986

[54] EMULSION HAVING HIGH SILVER CHLORIDE CONTENT, PHOTOGRAPHIC RECORDING MATERIAL AND PROCESS FOR THE PRODUCTION OF PHOTOGRAPHIC RECORDINGS

[75] Inventor: Sieghart Klötzer, Cologne, Fed. Rep. of Germany

[73] Assignee: Agfa-Gevaert Aktiengesellschaft, Leverkusen-Bayerwerk, Fed. Rep. of Germany

[21] Appl. No.: 708,720

[22] Filed: Mar. 6, 1985

[30] Foreign Application Priority Data

Mar. 15, 1984 [DE] Fed. Rep. of Germany ..... 3409442

[51] Int. Cl.[4] ..... G03C 1/02

[52] U.S. Cl. ..... 430/567; 430/376; 430/569

[58] Field of Search ..... 430/567, 940, 569, 376

[56] References Cited

U.S. PATENT DOCUMENTS

| | | | |
|---|---|---|---|
| 3,935,014 | 1/1976 | Klötzer et al. | 430/567 |
| 4,070,190 | 1/1978 | Friedrich et al. | 430/567 |
| 4,335,199 | 6/1982 | Mickewich | 430/567 |
| 4,444,865 | 4/1984 | Silverman et al. | 430/940 |
| 4,444,871 | 4/1984 | Miyaoka et al. | 430/378 |

FOREIGN PATENT DOCUMENTS

| | | |
|---|---|---|
| 0080905 | 6/1983 | European Pat. Off. |
| 1027146 | 4/1966 | United Kingdom . |

*Primary Examiner*—Mary F. Downey
*Attorney, Agent, or Firm*—Connolly And Hutz

[57] ABSTRACT

A chloride-rich silver halide emulsion with grains having in the interior thereof a zone having a high bromide content is described.

9 Claims, No Drawings

EMULSION HAVING HIGH SILVER CHLORIDE CONTENT, PHOTOGRAPHIC RECORDING MATERIAL AND PROCESS FOR THE PRODUCTION OF PHOTOGRAPHIC RECORDINGS

This invention relates to an emulsion having a high silver chloride content, a photographic recording material and a process for the production of photographic recordings.

Numerous types of silver halide emulsions in which the halide content consisting of chloride, bromide, iodide or mixtures thereof are known. For recording materials having a relatively high sensitivity, it is customary to use silver bromide or silver iodobromide emulsions. One disadvantage of the last-mentioned emulsions is that they have an intrinsic sensitivity in the blue region of the spectrum. Green-sensitive and red-sensitive layers used in colour recording materials are therefore generally arranged behind a filter which absorbs blue light. Furthermore, such emulsions cannot be developed as rapidly as silver chloride emulsions.

Proposals for using silver chloride emulsions are known from various publications. Since silver chloride has virtually no intrinsic sensitivity in the visible spectrum, filter layers for the absorption of blue light (yellow filters) are unnecessary when chloride-rich silver halide emulsions are used in a colour photographic recording material. The disadvantage of silver chloride emulsions, however, is the low sensitivity thereof. According to EP-A No. 0 017 148, the sensitivity may be improved by metal doping. Silver halide emulsions having a high chloride content have the further disadvantage of poor storage stability and hence a tendency to fogging. According to EP-A No. 0 072 695, fogging may be reduced by using silver halide solvents during chemical ripening.

Chloride-containing silver halide emulsions are known in which the grains have a layered structure. Such grains comprise a core enveloped in at least one layer which has different properties from those of the core (core/shell emulsions). The precipitation of a silver chloride shell on a silver bromide core is disclosed in DE-AS No. 1,169,290 and in GB No. 1,027,146. DE-OS No. 2,308,239 and U.S. Pat. No. 3,935,014 relate to emulsions for the production of direct positive images, which contain silver halide grains having a localised phase with a high silver chloride content.

Silver halide emulsions having silver chloride-rich grains having a surface layer consisting substantially of silver bromide are disclosed in EP-A No. 0 080 905.

The known chloride-rich silver halide emulsions, however, still leave room for improvement in other respects, especially in the sensitivity and tendency to fogging thereof.

One of the objects of the present invention was therefore to provide chloride-rich silver halide emulsions having improved sensitometric properties. It was particularly an object of the present invention to increase the sensitivity and reduce the tendency to fogging.

A photographic silver halide emulsion has now been found in which the halide content consists substantially of chloride and the grains have at least one zone $Z_{Br}$ having a high bromide content. The grains are characterised in that:

(1) at least 60 mol % of the halide is chloride;

(2) the bromide content in zone $Z_{Br}$ amounts to at least 50 mol %; and (3) no bromide-rich zone $Z_{Br}$ is situated on the surface of the silver halide grains.

The silver bromide-rich zone $Z_{Br}$ may be present as the core or as a layer within the silver halide grain. Preferably 20 vol. % of the silver halide of the grain is further removed from the centre of the crystal than the silver bromide-rich zone $Z_{Br}$.

The siliver halide grains may in principle contain chloride, bromide, iodide or mixtures thereof both in the bromide-rich zone $Z_{Br}$ and in the other regions. The transition from the bromide-rich zone $Z_{Br}$ to an adjacent zone having a different composition may be sharp or gradual.

In a preferred embodiment, the chloride content amounts to at least 85 mol %, in particular at least 90 mol % of the total halide content. In another preferred embodiment, the silver bromide-rich zone $Z_{Br}$ consists substantially, e.g. to an extent of at least 90%, or exclusively of silver bromide.

The silver halide emulsions according to the present invention may be prepared by the conventional methods (e.g. single inflow or double inflow, with constant or accelerated flow rate). The production by double inflow with control of the pAg value is particularly preferred, see Research Disclosure No. 17643 of December 1978, sections I and II, published by Industrial Opportunities Ltd., Homewell Havant, Hampshire PO9 1EF, Great Britain. The precipitation of the silver halide may be conducted in the presence of dopants, e.g. in the presence of Ir-compounds.

The silver halide grains may be, for example, in the form of cubes, octahedrons or tetradecahedrons. The grain size is preferably from 0.1 to 2.5 μm, more preferably from 0.2 to 1.0 μm.

In one embodiment of the present invention, the emulsion has a narrow grain size distribution. In particular, at least 95%, by weight, of the grains have a diameter deviating by not more than 40% from the average grain diameter. The emulsions may, however, have a wide grain size distribution, with at least 10%, preferably 20%, of the silver halide grains having a diameter deviating from the average grain diameter by at least 40%.

The present invention also relates to a photographic recording material containing at least one silver halide emulsion layer according to the present invention on a support. In addition, the present invention relates to a process for the production of photographic recordings by the development of an exposed recording material according to the present invention.

The emulsions according to the present invention are preferably chemical sensitized to a high surface sensitivity on the surface of the grains. They may be chemically sensitized by known methods, e.g. with active gelatin or with compounds of sulphur, selenium, tellurium, gold, palladium, platinum or iridium. The pAg values when carrying out such sensitization may vary from 4 to 10, the pH values from 3.5 to 9 and the temperature from 30° to 90° C. Chemical sensitization may be carried out in the presence of heterocyclic nitrogen compounds, such as imidazoles, azaindenes, azapyridazines and azapyrimidines, thiocyanate derivatives, thioethers and other silver halide solvents. Instead of this chemical sensitization or in addition thereto, the emulsions according to the present invention may be subjected to a reduction sensitization, e.g. by means of hydrogen, a low pAg (e.g. below 5) and/or high pH (e.g. above 8), or reducing agents, such as tin(II) chloride, thiourea dioxide and aminoboranes. The nuclei which are ripened on the surface may also be present as troglodyte nuclei (sub-surface nuclei) according to DE-OS No. 2,306,447 and U.S. Pat. No. 3,966,476. Other methods have been described in the above-mentioned Research Disclosure No. 17643, in Section III.

The emulsions may be optically sensitized in known manner, e.g. with the conventional polymethine dyes, such as neutrocyanines, basic or acid carbocyanines, rhodacyanines, hemicyanines, styryl dyes, oxonoles and the like. Sensitizers of this type have been described by F. M. Hamer in "The Cyanine Dyes and Related Compound", (1964). See also EP-A 0 082 649 and in particular Ullmanns Encyclopädie der technischem Chemie, 4th Edition, Volume 18, pages 431 et seq and the a bove-mentioned Research Disclosure No. 17643, Section IV. Spectral sensitization may be carried out at any stage in the preparation of the emulsion, i.e. during or after silver halide precipitation and before, during or after chemical sensitization.

The conventional anti-fogging agents and stabilizers may be used.

Azaindenes are particularly suitable stabilizers, especially the tetra- and penta-azaindenes, more particularly those which are substituted with hydroxyl or amino groups. Compounds of this type have been described, e.g. in the article by Birr, Z. Wiss. Phot. 47, 1952, pages 2–58. Other suitable stabilizers and anti-fogging agents are indicated in the above-mentioned Research Disclosure No. 17643, in Section IV.

The recording material according to the present invention is preferably a colour photographic material. In a preferred embodiment, the colour image is produced with the aid of colour couplers. The colour coupler may be arranged to diffuse into the recording material at the stage of development.

In a preferred embodiment, however, the photographic material itself contains the conventional colour couplers which are capable of reacting with the oxidation product of developers, generally p-phenylene diamines, to form dyes. Thus, the red-sensitive layer, for example, may contain a non-diffusible colour coupler to produce the cyan partial colour image, generally a coupler of the phenol or $\alpha$-napthol series. The green-sensitive layer may contain, for example, at least one non-diffusible colour coupler to produce the magenta partial colour image, generally a colour coupler of the 5-pyrazolone series. The blue-sensitive layer may contain, for example, a non-diffusible colour coupler to produce the yellow partial colour image, generally a colour coupler having an open-chain ketomethylene group. The colour couplers may be, for example, 6-, 4- or 2-equivalent couplers, including so-called white couplers which do not produce a dye in reaction with colour developer oxidation products. Suitable couplers have been disclosed, for example, in the publications, "Farbkuppler" by W. Pelz in "Mitteilungen aus den Forschungslaboratorien der Agfa, Leverkusen/München", Volume III, page 111 (1961); K. Venkataraman in "The Chemistry of Synthetic Dyes", Volume 4, 341 to 387, Academic Press (1971); T. H. James, "The Theory of the Photographic Process", 4th Edition, pages 353–362, and Research Disclosure No. 17643, Section VII.

The recording material may also contain DIR compounds, which are compounds which react with colour developer oxidation products to release diffusible organic compounds which inhibit the development of silver halide. The inhibitors may be split off directly or by way of non-inhibiting intermediate compounds. See Gb No. 953,454, U.S. Pat. Nos. 3,632,345, 4,248,962 and GB No. 2,072,363.

The colour couplers and DIR compounds may be incorporated in the materials according to the present invention by known methods. If they are water-soluble or alkali-soluble compounds, they may be added in the form of aqueous solutions, optionally with the addition of water-miscible organic solvents such as ethanol, acetone or dimethyl formamide. If, on the other hand, the colour couplers and DIR compounds are insoluble in water and alaklies, they may be incorporated in the recording materials in the form of dispersions in known manner. For example, a solution of these compounds in a low boiling organic solvent may be directly mixed with the silver halide emulsion or it may first be mixed with an aqueous gelatine solution, the organic solvent being then removed and the resulting dispersion of the particular compound being subsequently mixed with the silver halide emulsion. Socalled oil-formers may also be added; these are generally relatively high boiling organic compounds which form oily droplets occluding the colour couplers and DIR compounds which are to be dispersed. See in this connection, for example, U.S. Pat. Nos. 2,322,027; 2,533,514; 3,689,271; 3,764,336 and 3,765,897.

The recording materials according to the present invention preferably contain at least one unit of silver halide emulsion layers for recording blue, green and red light.

The red-sensitive silver halide emulsion layer unit may be arranged closer to the layer support than the green-sensitive silver halide emulsion layer unit, which in turn may be arranged closer to the support than the blue-sensitive unit. The positions of the blue-sensitive and the red-sensitive layers may, however, be reversed, especially in copying materials. The recording material may also contain a yellow filter layer, but this may be dispensed with, in particular if at least the red-sensitive and green-sensitive layers contain an emulsion according to the present invention.

In a preferred embodiment of the present invention, at least one of the units for the recording of green, red and blue light is composed of at least two partial layers. Partial layers which differ in spectral sensitization may also be combined according to sensitivity.

The conventional layer supports may be used for the materials according to the present invention, e.g. supports of cellulose esters, such as cellulose acetate or of polyesters. Paper supports are also suitable, and these may be coated, e.g. with polyolefins, in particular with polyethylene or polypropylene. See in this connection the above-mentioned Research Disclosure No. 17643, Section XVII.

The conventional hydrophilic film-forming substances may be used a protective colloids or binders for the layers of the recording material, e.g., proteins, in particular gelatine, alginic acid or derivatives thereof, such as esters, amides or salts, cellulose derivatives, such as carboxymethyl cellulose and cellulose sulphates, starches or derivatives thereof or hydrophilic synthetic binders, such as polyvinyl alcohol, saponified polyvinyl acetate, polyvinyl pyrrolidone, etc. The hydrophilic binders in the layers may also be mixed with other synthetic binders present in the form of solutions or dispersions, such as homo- or co-polymers of acrylic or methacrylic acid or deriatives thereof, such as esters, amides or nitriles, or vinyl polymers, such as vinyl esters or vinyl ethers. See also the binders indicated in the above-mentioned Research Discosure No. 17643, Section IX.

The layers of the photographic material may be hardened in the conventional manner, for example, using hardeners of the epoxide type, the heterocyclic ethylene imine or acryloyl type. The layers may also be hardened by the process according to the German Offenlegungsschrift No. 2,218,009 to produce colour photographic materials suitable for high temperature processing. Hardeners of the diazine, triazine or 1,2-dihydroquinoline series or vinyl sulphone series may also be used to harden the photograhic layers or colour photographic multi-layered materials. Other suitable hardeners are disclosed in German Offenlegungsschrift Nos. 2,439,551; 2,225,230 and 2,317,672 and the above-mentioned Research Disclosure No. 17643, Section XI.

The photographic materials according to the present invention may also contain other substances, in particular plasticizers, wetting agents, shielding dyes, light scattering agents, light reflecting agents, lubricants, anti-static agents, matting agents, etc., see Research Disclosure No. 17643 and "Product Licensing Index" of December 1971, pages 107–110.

Colour developer substances of the p-phenylene diamine series are particularly suitable for the material according to the present invention, e.g. 4-amino-N,N-diethyl aniline hydrochloride; 4-amino-3-methyl-N-ethyl-N-β-(methane sulphonamide)-ethylaniline sulphate hydrate; 4-amino-3-methyl-N-ethyl-N-β-hydroxyethyl aniline sulphate; 4-amino-N-ethyl-N-(2-methoxyethyl)-m-toluidine-di-p-toluene sulphonic acid and N-ethyl-N-β-hydroxyethyl-p-phenylene diamine. Other suitable colour developers have been described, for example, in J. Amer. Chem. Soc. 73, 3100, (1951), and in G. Haist, Modern Photographic Processing, 1979, John Wiley and Sons, New York, pages 545 et seq.

The colour developers may contain the conventional constituents, e.g. water softeners and antioxidants and fog modifying substances, e.g. bromide, or known stabilizers.

The material is conventionally bleached and fixed after colour development. Bleaching and fixing may be carried out separately or together. The conventional compounds may be used as bleaching agents, e.g. $Fe^{3+}$ salts and $Fe^{3+}$ complex salts, such as ferricyanides, or dichromates, water-soluble cobalt complexes, etc. Iron-III complexes of amino polycarboxylic acids are particularly preferred, e.g. ethylene diamine tetracetic acid, nitrilotriacetic acid, iminodiacetic acid, N-hydroxyethylethylene diamino triacetic acid, alkyliminodicarboxylic acids and corresponding phosphonic acids. Persulphates are also suitable bleaching agents.

EXAMPLE 1

Emulsion A According to the Present Invention

A silver chloride emulsion is prepared within 18 minutes by simultaneous, pAg-controlled inflow of a 0.3N NaCl and a 0.3N $AgNO_3$ solution into a 2.4% gelatine solution which has been raised to a temperature of 60° C. The average particle size is 0.16 μm and the emulsion has a monodisperse distribution. The crystals of this starting emulsion are increased to 13.4 times their volume by further addition of 2N NaCl and 2N $AgNO_3$ solutions while the pAg is maintained constant at 6.8. An AgBr shell is precipitated on the resulting AgCl emulsion by the double inflow of 2N KBr and 2N $AgNO_3$ solutions. Precipitation is then continued by pAg-controlled double inflow of 2N NaCl and 2N $AgNO_3$ solutions so that an AgCl shell is precipitated on the previously precipitated AgBr layer. The thus prepared emulsion has an average particle diameter of 0.58 μm and a monodisperse distribution. The total AgBr content is 6 mol %.

Comparison Emulsion B

For purposes of comparison, a silver halide emulsion is prepared by the same method of pAg-controlled double inflow as emulsion A, but the alkali metal halide solution used at every stage of precipitation is a mixture of NaCl/KBr. This mixed halide solution contains 94 mol % of NaCl and 6 mol % of KBr. The solutions are used at the concentrations indicated for emulsion A. The thus-prepared silver halide emulsion has an average particle diameter of 0.60 μm and a monodisperse grain side distribution. Its total AgBr content is 6 mol %, which is homogeneously distributed within the whole crystal.

Emulsions A and B are freed from soluble salts by flocculation and washing in the conventional manner and then adjusted to pAg value of 7.6. Both emulsions are then chemically sensitized for 120 minutes at 55° C. by the addition of sodium thiosulphate. For the sensitometric test, a sensitized dye absorbing in the green region of the spectrum and a conventional magenta coupler emulsion are added to the ripened emulsions which are then applied to a layer support.

After exposure behind a step wedge and processing by the colour development process disclosed in British Journal of Photography, [1984], page 597, the sensitometric data shown in Table 1 are obtained.

TABLE 1

| Emulsion | Relative sensitivity | Fog | $D_{max}$ |
|---|---|---|---|
| A (invention) | 227 | 0.17 | 3.65 |
| B (comparison) | 100 | 0.21 | 3.70 |

Table 1 shows that emulsion A according to the present invention has less fog and a substantially higher sensitivity.

EXAMPLE 2

An emulsion C according to the present invention is prepared according to the present application by a method similar to that described in Example 1. The emulsion resembles emulsion A described there in containing an AgBr layer, the AgBr content, based on the total halide content, being 5 mol %. This emulsion C has a monodisperse grain size distribution and an average particle diameter of 0.56 μm.

For comparison purposes, an emulsion as described in European patent application 080 905, Example 1, under Em-4 is prepared by pAg-controlled double inflow of aqueous silver nitrate and halide solutions. In order that this comparison emulsion D may be sensitometrically comparable to emulsion C according to the present invention, the AgCl core is enlarged before precipitation of the AgBr shell so that the final grain size of this emulsion amounts to 0.57 μm. This emulsion also has a narrow (monodisperse) grain size distribution. The total AgBr content is 5 mol % and is situated exclusively in a layer on the crystal surface.

Emulsions C and D are freed from the soluble salts by flocculation and washing in the conventional manner and then adjusted to a pAg value of 7.6. after the addition of sodium thiosulphate pentahydrate, both emulsions are chemically sensitized in the same manner at 55° C. for 120 minutes.

For sensitometric examination, a dye absorbing in the green region of the spectrum and a conventional magenta coupler emulsion are added to the ripened emulsions and the emulsions are applied to a layer support.

After processing according to Example 1, the sensitometric values indicated in Table 2 are obtained. The relative sensitivity is based on the comparison emulsion D.

TABLE 2

| | Relative Sensitivity | Fog | Gradation | $D_{max}$ |
|---|---|---|---|---|
| Emulsion C (invention) | 560 | 0.17 | 2.74 | 3.41 |
| Emulsion D (comparison) | 100 | 0.15 | 2.38 | 3.47 |

Table 2 shows that the sensitivity of emulsion C according to the present invention is considerably higher than that of the comparison emulsion, while the sensitometric values are otherwise comparable.

EXAMPLE 3

For a further sensitometric comparison, a sensitizing dye absorbing the blue region of the spectrum and a yellow coupler emulsion are added to emulsions C and D of Example 2 after chemical ripening and the emulsions are cast on a layer support.

The sensitometric data obtained after exposure and processing by the colour development process described above are shown in Table 3 below.

TABLE 3

| | Relative Sensitivity | Fog | Gradation | $D_{max}$ |
|---|---|---|---|---|
| Emulsion C (invention) | 247 | 0.14 | 2.47 | 3.61 |
| Emulsion D (comparison) | 100 | 0.35 | 2.49 | 3.68 |

The emulsion comparison in Table 3 shows that emulsion C according to the present invention has a higher sensitivity with considerably reduced fog.

I claim:

1. Photographic silver halide emulsion in which the halide content consists substantially of chloride and the grains having at least one zone $Z_{Br}$ having a high bromide content, comprising (1) at least 60 mol % of the halide is chloride;

(2) the zone $Z_{Br}$ is positioned between a core and the surface layer of the grain;

(3) the bromide content in the zone $Z_{Br}$ amounts to at least 50 mol %; and (4) no bromide-rich Zone $Z_{Br}$ is present on the surface of the silver halide grains.

2. Photographic silver halide emulsion according to claim 1, wherein at least 85 mol % of the total halide present is chloride.

3. Photographic silver halide emulsion according to claim 1, wherein the halide in the bromide-rich zone $Z_{Br}$ consists substantially or exclusively of silver bromide.

4. Photographic silverhalide emulsion according to claim 1, wherein the average grain size is from 0.1 to 2.5 μm.

5. Photographic silver halide emulsion according to claim 1, wherein it has a narrow grain size distribution.

6. Photographic silver halide emulsion according to claim 1, wherein the emulsion has a wide grain size distribution.

7. Photographic silver halide emulsion according to claim 1, wherein it is chemically and spectrally sensitized on the surface.

8. Color photographic recording material comprising a support and at least one silver halide emulsion layer applied thereto, and at least one color coupler, wherein the grains of said emulsion comprises at least 60 mol percent of chloride and a zone $Z_{Br}$ with a Br content of at least 50 mol percent is positioned between a core and the surface layer of the grain and wherein no zone $Z_{Br}$ is present on the surface of the grains.

9. A process of producing photographic recording by development of an exposed recording material having at least one supported silver halide emulsion layer and at least one color coupler, wherein the grains of said emulsion comprises at least 60 mol percent of chloride and a zone $Z_{Br}$ with a Br content of at least 50 mol percent is positioned between a core and the surface layer of the grain and wherein no zone $Z_{Br}$ is present on the surface of the grains, wherein the development of the exposed recording material is in the presence of a p-phenylene diamine.

* * * * *